US008184998B2

(12) United States Patent
Morikuni

(10) Patent No.: US 8,184,998 B2
(45) Date of Patent: May 22, 2012

(54) IMAGE FORMING APPARATUS, AND METHOD AND PROGRAM FOR DETERMINING TIMING TO EXECUTE IMAGE ADJUSTING PROCESSING

(75) Inventor: Shuhichi Morikuni, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 320 days.

(21) Appl. No.: 12/478,817

(22) Filed: Jun. 5, 2009

(65) Prior Publication Data

US 2009/0304399 A1 Dec. 10, 2009

(30) Foreign Application Priority Data

Jun. 6, 2008 (JP) ..... 2008-148768

(51) Int. Cl.
*G03G 15/08* (2006.01)
*G03G 15/00* (2006.01)

(52) U.S. Cl. ..... 399/30; 399/49

(58) Field of Classification Search ..... 399/27, 399/30, 49, 53, 61, 62, 258, 260
See application file for complete search history.

(56) References Cited

U.S. PATENT DOCUMENTS 6,501,916 B2 * 12/2002 Suzuki ..... 399/30
7,203,433 B2 * 4/2007 Kato et al. ..... 399/49
7,251,420 B2 * 7/2007 Fujimori et al. ..... 399/27
2004/0160620 A1 * 8/2004 Ikegami et al. ..... 358/1.13
2008/0019712 A1 * 1/2008 Tanaka et al. ..... 399/30

FOREIGN PATENT DOCUMENTS

| | | |
|---|---|---|
| JP | 04-204468 | 7/1992 |
| JP | 07-013430 | 1/1995 |
| JP | 11-202605 | 7/1999 |
| JP | 2005-121935 A | 5/2005 |
| JP | 2008-046339 A | 2/2008 |

OTHER PUBLICATIONS

JP Office Action mailed Apr. 20, 2010 in corresponding JP application 2008-148768.

* cited by examiner

*Primary Examiner* — Sandra Brase
(74) *Attorney, Agent, or Firm* — Nixon & Vanderhye P.C.

(57) ABSTRACT

An image forming apparatus includes a toner replenishing device that supplies toner, based on a detection result from a sensor that detects a toner density in a developing device that develops an electrostatic latent image based on an image signal with toner, so that the toner density takes a given value, a memory portion that counts a time for toner replenishment actually carried out by the toner replenishing device to accumulate count results as an accumulated actual toner replenishment time, a memory portion that calculates an expected required time for toner replenishment based on the image signal to accumulate calculation results as an accumulated expected toner replenishment time, and a determining portion that determines in given timing whether or not to execute the image quality adjusting processing, based on a difference between the accumulated actual toner replenishment time and the accumulated expected toner replenishment time.

6 Claims, 9 Drawing Sheets

FIG. 4

T1

| AVERAGE PAPER PRINT RATIO | REQUIRED TONER AMOUNT/A4 PAPER SIZE (mg) | ROTATION TIME OF TONER REPLENISHING MOTOR (sec) |
|---|---|---|
| 100% | 350.0 | 1.00 |
| 15% | 52.5 | 0.15 |
| 5% | 17.5 | 0.05 |
| 3% | 11.7 | 0.03 |

FIG. 6

T2

| ACCUMULATED NUMBER OF PRINTED SHEETS (K) | SET NUMBER OF PRINTED SHEETS (NUMBER OF A4 SIZE SHEETS) |
|---|---|
| ~30K | 1000 |
| ~60K | 900 |
| ~100K | 800 |

IMAGE FORMING APPARATUS, AND METHOD AND PROGRAM FOR DETERMINING TIMING TO EXECUTE IMAGE ADJUSTING PROCESSING

CROSS-NOTING PARAGRAPH

This non-provisional application claims priority under 35U.S.C. §119 (a) on Patent Application No. 2008-148768 filed in JAPAN on Jun. 6, 2008, the entire contents of which are hereby incorporated herein by reference.

FILED OF THE TECHNOLOGY

The present technology relates to an image forming apparatus, such as a copier and a printer employing an electrophotographic method, particularly to an image forming apparatus that properly executes image quality adjustment while keeping a proper toner density to maintain a print image quality, and to a method and a program for determining timing to execute an image adjustment process in the image forming apparatus.

BACKGROUND OF THE TECHNOLOGY

In general, an image forming apparatus employing an electrophotographic method carries out image forming using a binary developer mixed nonmagnetic toner with a magnetic carrier. It is important to maintain a proper mixing ratio (toner density) between the toner and the carrier for the image forming apparatus to carry out image forming using the binary developer. This is because that if the toner density of the developer in a developing container becomes under a proper value, darkness of image decreases, and that if the toner density exceeds a proper value, such a trouble as so-called fogging happens, which is a phenomenon of tonner's sticking to the part of a recording paper to which toner is not supposed to stick.

For the above reason, it is necessary to accurately detect a toner density and control the toner density to a proper value in order to acquire a fine printed image.

Two toner replenishment controlling methods are available, an inductance detecting method (which is also referred to as a magnetic permeability sensor method) and a video count method (which is also referred to as a dot count method).

The inductance detecting method is the method to control toner replenishment based on the magnetic permeability of a developer that is detected by a popularly used magnetic permeability sensor (toner density sensor).

The video count method is the method to calculate the print ratio of a printed paper (i.e., the ratio of a printed area to the total area of a printed paper), estimate a toner consumption amount based on the calculated print ratio, and control toner replenishment based on the estimated toner consumption amount.

Japanese Laid-Open Patent Publication No. 11-202605 discloses an image forming apparatus that carries out toner density control by the video count method from the start of operation to a point that the number of printed sheets reaches the given number of sheets, and that carries out toner density control by the inductance detecting method after the end of the video counter method.

Japanese Laid-Open Patent Publication No. 04-204468 discloses a toner replenishing device that changes a toner density level for starting toner replenishment by the inductance detecting method, in accordance with a print ratio of a printed paper.

According to the video count method, an operation of a toner replenishing device is calculated based on an estimated toner consumption amount. Since an actual toner consumption amount and an actual toner supply amount per unit operation time of the toner replenishing device change depending on an environmental condition of the device, it sometimes occurres a decrease of darkness of printing that is caused by a decrease in the toner density of a developer resulting from an insufficient toner supply or an excessive contrast of printed image (quality) and toner fogging on a background that are caused by an increase in the toner density of the developer resulting from an excessively ample toner supply.

As described above, proper toner density control is difficult when toner replenishment is controlled only by the video count method.

According to the inductance detecting method, a toner density is measured with a toner density sensor, so that an actual toner density can be kept constant.

An image forming apparatus usually carries out an image quality adjusting processing (so-called process control) to securely keep an image quality in a fine state. This image quality adjusting processing is the processing for forming a reference toner patch on a photosensitive material, detecting the optical reflectance (reflection light density), etc., of the reference toner patch (or the reference toner patch temporarily transferred to an intermediate transferrer), determining a toner sticking amount, etc., on the reference toner patch based on the detected optical reflectance, and adjusting a developing bias condition, etc., based on the determined toner sticking amount.

A conventional image forming apparatus carries out this image quality adjusting processing every time the accumulated number of printed sheets exceeds the given number of sheets. This approach, however, may lead to such a case, depending on the condition of the apparatus, where the image quality adjusting processing is carried out when the processing is unnecessary or where the image quality adjusting processing is not carried out when the processing is necessary. In particular, because the image quality adjusting processing takes time, excessively executing the processing invites a decline in print job efficiency. It is, therefore, preferable that timing to execute the image quality adjusting processing be variable depending on the condition of the apparatus. Japanese Laid-Open Patent Publication No. 11-202605 and Japanese Laid-Open Patent Publication No. 04-204468, however, present no disclosure or suggestion on this respect.

SUMMARY OF THE TECHNOLOGY

It is an object of the present technology to provide an image forming apparatus that keeps a toner density at a given value by supplying toner using an inductance detecting method and reduces the frequency of execution of the image quality adjusting processing, by varying timing to execute an image quality adjustment processing in accordance with the condition of the apparatus, and a method and a program for determining timing to execute the image quality adjusting processing in the image forming apparatus.

Another object of the present technology is to provide an image forming apparatus comprising: an electrostatic latent image carrier on which an electrostatic latent image is formed based on an image signal; a developing device that gives toner to the electrostatic latent image to form a toner image; a detecting portion that detects a toner density in the developing device; a toner replenishing device that supplies toner to the developing device based on a detection result from the detecting portion so that the toner density takes a given value; an accumulated actual time memory portion that counts a time for toner replenishment actually carried out by the toner replenishing device, accumulates the count results and stores therein the accumulated count results as an accumulated actual toner replenishment time; an accumulated expected time memory portion that calculates an expected required time for toner replenishment based on the image signal, accumulates calculation results and stores therein the calculation results as an accumulated expected toner replenishment time; and a determining portion that determines in given timing whether or not to execute an image quality adjusting processing, based on a difference between the accumulated actual toner replenishment time and the accumulated expected toner replenishment time.

Another object of the present technology is to provide the image forming apparatus, comprising a reflection density sensor that detects reflection light quantity of a toner patch formed for the image quality adjusting processing, wherein when execution of the image quality adjusting processing is determined, the image quality adjusting processing is suspended when the reflection light quantity of the toner patch is equal to or more than a given value and the accumulated expected toner replenishment time in the following determination is corrected.

Another object of the present technology is to provide the image forming apparatus, comprising a conversion table memory portion that has stored therein a conversion table used for calculating the expected required time for toner replenishment, wherein correct the accumulated expected toner replenishment time in the following determination is corrected by correcting the conversion table.

Another object of the present technology is to provide the image forming apparatus, comprising a counter that counts an accumulated number of printed sheets, wherein an interval for executing the determination is reduced as the accumulated number of printed sheets increases.

Another object of the present technology is to provide the image forming apparatus, wherein a single-cell elastic expandable member is used for a toner replenishing roller of the toner replenishing device.

Another object of the present technology is to provide a method for determining timing to execute an image quality adjusting processing in an image forming apparatus which includes an electrostatic latent image carrier on which an electrostatic latent image is formed, a developing device that gives toner to the electrostatic latent image to form a toner image, a detecting portion that detects a toner density in the developing device, and a toner replenishing device that supplies toner to the developing device, wherein the method comprises the steps of: supplying toner from the toner replenishing device, based on a detection result from the detecting portion, so that the toner density takes a given value; counting a time for toner replenishment actually carried out by the toner replenishing device and accumulating count results to calculate the accumulated count results as an accumulated actual toner replenishment time; calculating an expected required time for toner replenishment based on the image signal and accumulating calculation results to calculate the accumulated calculation results as an accumulated expected toner replenishment time; calculating a difference between the accumulated actual toner replenishment time and the accumulated expected toner replenishment time; and determining in given timing whether or not to execute an image quality adjusting processing, based on the calculated difference.

Another object of the present technology is to provide a program that causes a computer to execute the method for determining timing to execute an image quality adjusting processing in the image forming apparatus mentioned above.

BRIEF DESCRIPTION OF THE DRAWINGS

FIG. 4 is a diagram of an example of a conversion table that is used when a toner replenishment time expected to be required for supplying an amount of tonner equivalent to a printed image for one page is calculated;

FIG. 6 is a diagram of an example of a trigger number of printed sheets table that bears information for determining timing of carrying out a determination on whether or not execute the image quality adjustment processing;

PREFERRED EMBODIMENTS OF THE INVENTION

Figure 1:
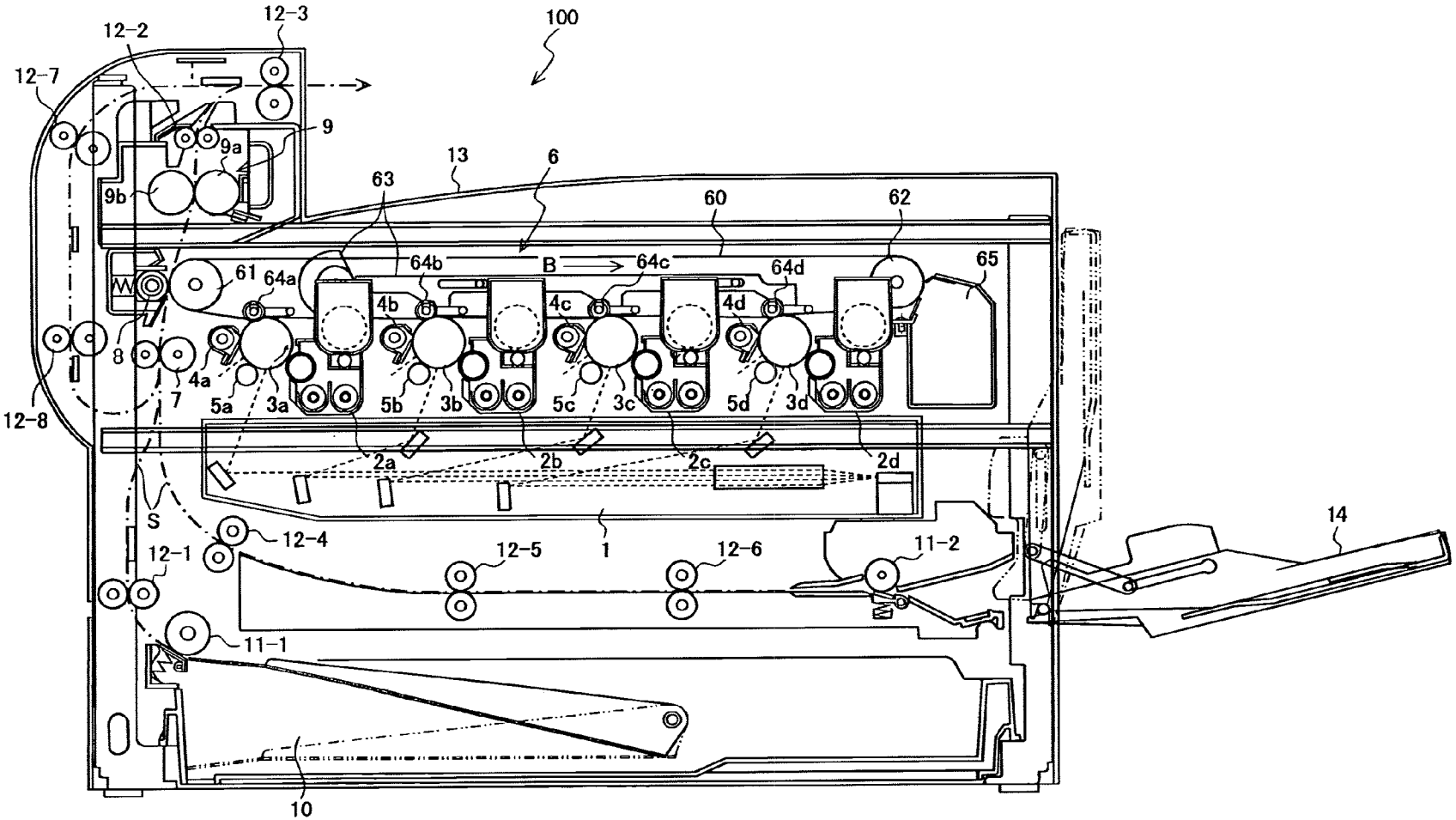
FIG. 1 is a schematic sectional view for explaining an overall configuration example of an image forming apparatus of the present technology.

FIG. 1 is a schematic sectional view for explaining an overall configuration example of an image forming apparatus of the present technology. The image forming apparatus 100 of FIG. 1 forms a multicolor image or a single color image on a given sheet (recording paper) in accordance with externally transmitted image data. The image forming apparatus 100 includes an exposure unit 1, developing devices 2 (2*a*, 2*b*, 2*c*, and 2*d*), photosensitive drums 3 (3*a*, 3*b*, 2*c*, and 3*d*), cleaner units 4 (4*a*, 4*b*, 4*c*, and 4*d*), electrifiers 5 (5*a*, 5*b*, 5*c*, and 5*d*), an intermediate transfer belt unit 6, a resist roller 7, a transfer roller 8, a fixing unit 9, a paper feeding tray 10, a paper transport passage S, and a paper ejecting tray 13. In FIG. 1, reference symbols a to d following reference numbers denoting constituent portions are appended to constituent portions corresponding to colors of black, cyan, magenta, and yellow, respectively. These reference symbols will be omitted properly in the following description.

Image data processed in the image forming apparatus 100 corresponds to a color image generated by using the colors of black (B), cyan (C), magenta (M), and yellow (Y). Four image stations each of which is composed of the developing device 2, the photosensitive drum 3, the cleaner unit 4, and the electrifier 5, therefore, are provided to form four kinds of latent images that correspond to four colors, respectively.

The exposure unit 1 scans the electrified photosensitive drum 3 with laser light emitted from an LD in accordance with input image data to form an electrostatic latent image corresponding to the input image data on the photosensitive drum 3.

The developing device 2 is disposed near the photosensitive drum 3, and develops the electrostatic latent image formed on the photosensitive drum 3, using each of K toner, C toner, M toner, and Y toner. The cleaner unit 4 removes and recovers toner remained on the surface of the photosensitive drum 3 after development and image transfer are over. The electrifier 5 is an electrifying means that uniformly electrifies the surface of the photosensitive drum 3 to give the surface a prescribed voltage. The electrifier 5 of FIG. 1 is a contact type electrifier, but may be replaced with a charger type electrifier.

The intermediate transfer belt unit 6 is placed above the photosensitive drum 3. The intermediate transfer belt unit is composed of an intermediate transfer belt 60, an intermediate transfer belt driving roller 61, an intermediate transfer belt driven roller 62, an intermediate transfer belt tension mechanism 63, intermediate transfer rollers 64 (64*a*, 64*b*, 64*c*, and 64*d*), and an intermediate transfer belt cleaning unit 65. The intermediate transfer belt driving roller 61, the intermediate transfer belt driven roller 62, the intermediate transfer belt tension mechanism 63, the intermediate transfer rollers 64, etc., have the intermediate transfer belt 60 around them and move it in an arrowed direction B.

The intermediate transfer belt 60 is disposed to be in contact with the photosensitive drums 3. The intermediate transfer belt 60 has a function of sequentially superposing toner images of respective colors formed on the photosensitive drums 3 onto the intermediate transfer belt 60 and transferring the toner images to the transfer belt 60 to form a color toner image (multicolor toner image) on the intermediate transfer belt 60.

Transfer of a toner image from the photosensitive drum 3 to the intermediate transfer belt 60 is carried out by the intermediate transfer roller 64 that is in contact with the back of the intermediate transfer belt 60. The intermediate transfer roller 64 is supported rotatably on an intermediate roller fitting portion of the intermediate transfer belt tension mechanism 63 in the intermediate transfer belt unit 6. The intermediate transfer roller 64 supplies a transfer bias for transferring the toner image on the photosensitive drums 3 to the intermediate transfer belt 60.

The toner image formed in this manner is transferred to a paper by the transfer roller 8 disposed at a position of contact between the paper and the intermediate transfer belt 60.

Toner sticking to the intermediate transfer belt 60 as a result of contact between the intermediate transfer belt 60 and the photosensitive drum 3 or toner not transferred to the paper by the transfer roller 8 but remaining on the intermediate transfer belt 60 becomes the cause of mixing of toner colors in the next process. Such toner is, therefore, removed and recovered by the intermediate transfer belt cleaning unit 65. The intermediate transfer belt cleaning unit 65 is provided with a cleaning blade serving as a cleaning member that is in contact with the intermediate transfer belt 60. The intermediate transfer belt 60 in contact with the cleaning blade is supported by the intermediate transfer belt driven roller 62 on the back of the intermediate transfer belt 60.

The resist roller 7 is the roller that temporarily holds a sheet transported through the paper transport passage S, which will be described later. The resist roller 7 has a function for transporting the sheet to a transfer portion having the transfer roller 8 at the timing of meeting the leading edge of a toner image on the photosensitive drum 3 to the leading edge of the sheet.

The fixing unit 9 has a heat roller 9*b*, etc., that has a function of cooperating with a pressure roller 9*a* to subject a sheet to heat pressure bonding to melt, mix, and pressurize a multicolor toner image transferred to the sheet and fix the multicolor toner image by heat to the sheet. The pressure roller 9*a* and the heat roller 9*b* rotate over the sheet sandwiched between the rollers 9*a* and 9*b*.

The paper feeding tray 10 accumulates sheets used for image forming, and is disposed under the exposure unit 1.

The paper transport passage S is provided with the resist roller 7, the transfer roller 8, the pressure roller 9*a*, the heat roller 9*b*, pickup rollers (11-1 and 11-2), transport rollers (12-1 to 12-8), etc., which are arranged near the paper transport passage S.

The pickup roller 11-1 is disposed on an end of the paper feeding tray 10, serving as a feed-in roller that feeds sheets one by one from the paper feeding tray 10 into the paper transport passage S. The pickup roller 11-2 serves as a feed-in roller that feeds sheets one by one from a manual insertion tray 14 into the paper transport passage S.

The transport roller 12 is a small roller that assists in and facilitates transport of a paper, and a plurality of the transport rollers 12 are arranged along the paper transport passage S.

A sheet carrying a multicolor toner image fixed thereto is transported by the transport rollers 12-2 and 12-3 to a reverse paper ejecting path of the paper transport passage S, from which the sheet put in a reversed state (in which the multicolor toner image is faced downward) is ejected onto the paper ejecting tray 13. The paper ejecting tray 13 bears printed sheets placed thereon facedown, and is disposed on the top of the image forming apparatus 100.

The image forming apparatus 100 carries out image forming using the above constituent portions.

The image forming apparatus 100 has a reflection density sensor for an image quality adjusting process, which is not shown.

The reflection density sensor emits light onto a reference toner patch formed on the photosensitive drum 3 and receives reflection light from the patch when the image quality adjusting process is executed. An amount of toner on the reference toner patch is thus calculated optically based on the light quantity of received reflection light. The reflection density sensor is composed of a light-emitting element and a light-receiving element that detects reflection light, and is disposed to face the photosensitive drum 3 at a given position that is downstream to the developing device with respect to the direction of rotation of the photosensitive drum 3 and upstream to the intermediate transfer roller 64 with respect to the direction of rotation.

The reference toner patch having passed the intermediate transfer roller 64 during the image adjusting processing is removed by the cleaner unit 4.

In the image forming apparatus 100, a detection result from the reflection density sensor is acquired to determine a toner sticking amount on the reference toner patch based on the detection result. Based on this toner sticking amount, conditions for the image forming processing are adjusted. For example, a developing bias condition for the developing device 2 is adjusted.

Figure 2:
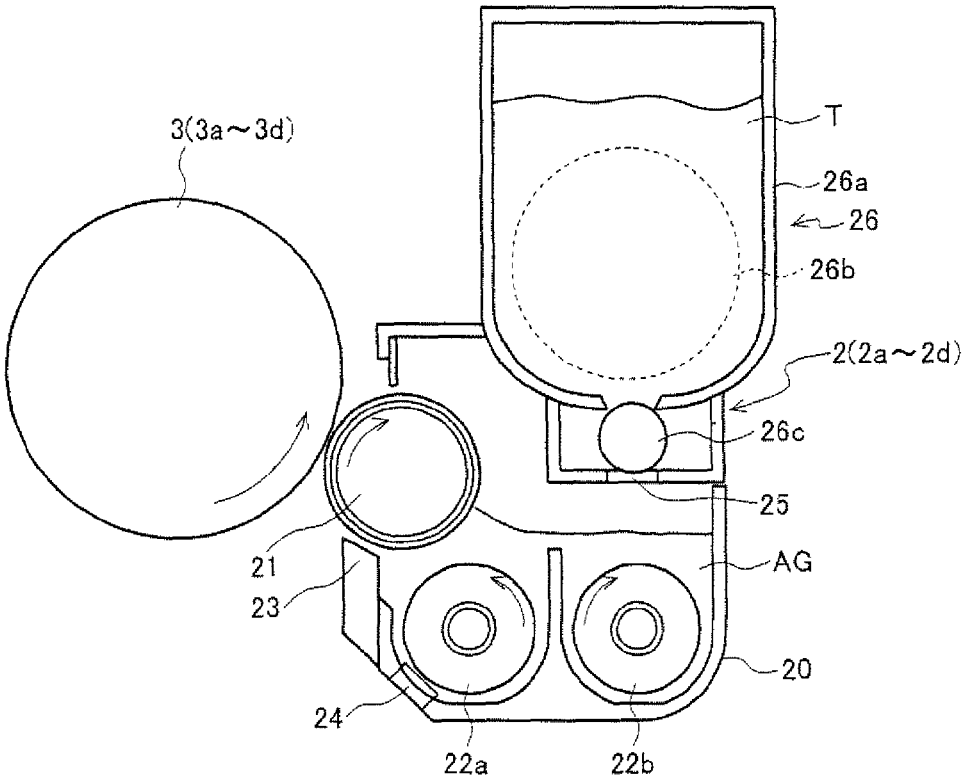
FIG. 2 is a magnified view of a developing device and a photosensitive drum in the image forming apparatus of the present technology.

FIG. 2 is a magnified view of the developing device 2 and the photosensitive drum 3 in the image forming apparatus 100 of the first embodiment.

The developing device 2 develops an electrostatic latent image formed on the photosensitive drum 3, which an instance of an electrostatic latent image carrier, into a toner image. The developing device 2 has a developing container 20 containing a binary developer AG as a mixture of nonmagnetic toner and a magnetic carrier, and a developing roller 21 that supplies the binary developer AG in the developing container 20 to the photosensitive drum 3. The developing roller 21 is disposed to face the photosensitive drum 3 in close proximity thereto.

The developing device 2 also has transport screws 22*a* and 22*b* that transport the binary developer AG in the developing container 20 to the developing roller 21 while stirring the binary developer AG, a doctor blade 23 that regulates an amount of the developer to be transported to the developing roller 21, and a toner density sensor (magnetic permeability sensor) that detects the magnetic permeability of the binary developer AG in the developing container 20 to detect the density of toner contained in the binary developer AG in the developing container 20.

An opening 25 for supplying toner into the developing container 20 is formed on the top of the developing container 20 of the developing device 2, so that the developing container 20 is replenished with toner from a toner replenishing device 26 disposed above the opening 25. The toner replenishing device 26 has a toner container 26*a* containing toner, a toner stirring member 26*b* that stirs toner T contained in the toner container 26*a*, and a toner replenishing roller 26*c* that supplies toner T while revolving to stir toner T in the toner container 26*a*. Toner T is thus supplied to the developing device 2 through the opening 25.

It is desirable that the toner replenishing roller 26*c* precisely supply a given amount of toner for each revolution. Using a porous elastic expandable member (sponge, etc.) as an elastic member forming the surface layer of the toner replenishing roller 26*c* is preferable because in the porous elastic expandable member, toner is transported through pores (a multiplicity of pores) formed substantially uniformly across the whole roller surface layer. It is more preferable if the elastic expandable member is a single-cell elastic expandable member (sponge having pores independent of each other). This is because that while using a continuous-cell elastic expandable member (sponge having a plurality of continuous pores) may cause a phenomenon that toner infiltrating to remain in the deep layer of the elastic expandable member hardens to break the elastic expandable member (elastic member), using a single-cell elastic expandable member prevents such a phenomenon.

The image forming apparatus 100 having the above developing device 2 uses an inductance detection method as a toner replenishment control method, by which method a toner density is detected by the toner density sensor 24 and toner supply from the toner replenishing device 26 is controlled based on the result of the detection so that the toner density detected by the sensor 24 is kept within a given range.

First Embodiment

The image forming apparatus of the present technology carries out toner replenishment control by the above inductance detection method and adjusts timing to execute the image quality adjusting processing in accordance with the condition of the apparatus. The image forming apparatus compares information on an actual toner replenishment time with information on an expected toner replenishment time calculated from the print ratio of a printed paper to determine the condition of the apparatus, and when a comparison result indicates a large difference between both times, determines that the apparatus has any kind of trouble, thus carries out the image adjusting processing.

Figure 3:
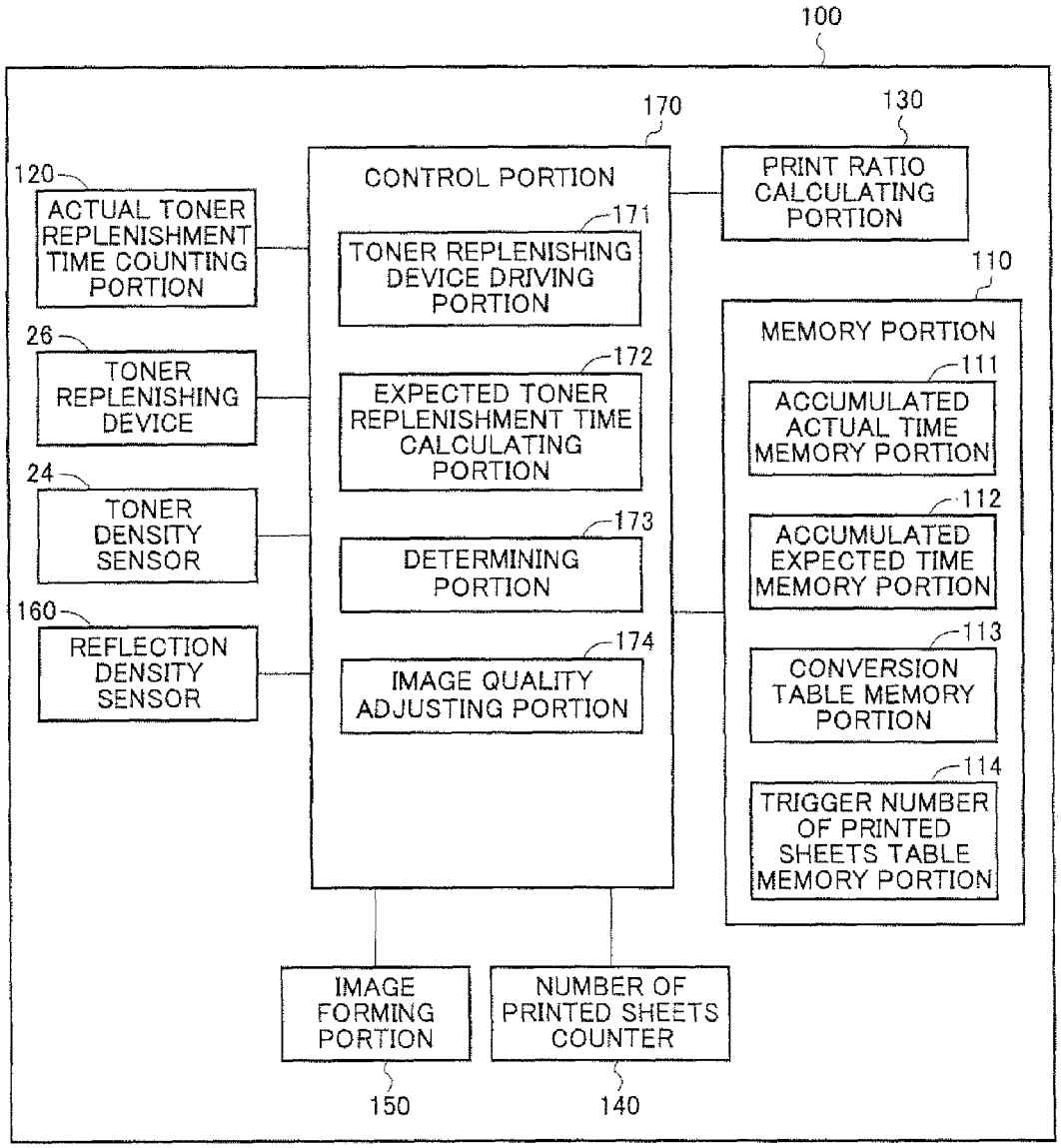
FIG. 3 is a block diagram for explaining a characteristic operation of an image forming apparatus of a first embodiment of the present technology.

FIG. 3 is a block diagram for explaining a characteristic operation of an image forming apparatus of a first embodiment of the present technology.

The image forming apparatus 100 of FIG. 3 includes a memory portion 110, an actual toner replenishment time counting portion 120, a print ratio calculating portion 130, a number of printed sheets counter 140, an image forming portion 150, a reflection density sensor 160, and a control portion 170.

The memory portion 110 stores various pieces of information therein, and has an accumulated actual time memory portion 111, an accumulated expected time memory portion 112, a conversion table memory portion 113, and a trigger number of printed sheets table memory portion 114. The accumulated actual time memory portion 111 sums times for toner replenishment actually carried out by the toner replenishing device 26 (equivalent to, e.g., operation time of a motor that rotates the toner replenishing roller) to store the summed time in the memory portion 111. The accumulated expected time memory portion 112 sums times for toner replenishment that are expected based on the print ratio of a printed paper, which will be described later, to store the summed time in the memory portion 112. Information stored in the accumulated actual time memory portion 111 and the accumulated expected time memory portion 112 is reset (i.e., set to "0") at the time of product shipment. The conversion table memory portion 113 has stored therein a conversion table for calculating an expected required time for toner replenishment. The trigger number of printed sheets table memory portion 114 will be described later.

The actual toner replenishment time counting portion 120 sums times for toner replenishment actually carried out by the toner replenishing device 26. Every time the toner replenishing device 26 is driven, for example, the actual toner replenishment time counting portion 120 counts an operation time of the motor that rotates the toner replenishing roller 26*c* (see FIG. 2). The counted actual operation time of the motor is sent to the control portion 170, which accumulates the actual operation time in the accumulated actual time memory portion 111, where the actual operation time is recorded as an accumulated actual toner replenishment time.

The print ratio calculating portion 130 calculates the print ratio (or dot count) of a printed manuscript based on image data on the printed paper, calculating the print ratio of a printed image related to printed paper data per page input to the image forming apparatus 100 to output a calculation result to the control portion 170.

The number of printed sheets counter 140 counts the accumulated number of printed sheets, and is set to a count value "0" at the time of product shipment. The image forming portion 150 executes the image forming processing based on printed paper data, and is made up of the exposure unit 1, the developing device 2, the photosensitive drum 3, etc. The reflection density sensor 160 detects, for example, the reflection density of a reference toner patch formed on the photosensitive drum 3 when the image adjusting processing is executed.

The control portion 170 carries out overall controls over the image forming apparatus 100, and has a toner replenishing device driving portion 171, an expected toner replenishing time calculating portion 172, a determining portion 173, and an image quality adjusting portion 174.

The toner replenishing device driving portion 171 controls the toner replenishing device 26 based on a detection result from the toner density sensor 24. Information on the start and stop of drive of the toner replenishing device 26 is sent to the actual toner replenishment time counting portion 120, where an accumulated actual toner replenishment time is counted.

The expected toner replenishing time calculating portion 172 calculates a toner replenishment time expected to be required for replenishing an amount of toner equivalent to a printed image for one page, based on a print ratio calculated by the print ratio calculating portion 130 for each printed image for one page. The calculated expected required time for toner replenishment is accumulated in the accumulated expected time memory portion 112, where the required time for toner replenishment is recorded as an accumulated expected toner replenishment time. The expected toner replenishing time calculating portion 172 is allowed to use the conversion table shown in FIG. 4 when calculating the above expected toner replenishing time.

The conversion table T1 of FIG. 4 is the table bearing the description of a toner replenishment time expected to be required for a printed image for one page, which toner replenishment time is correlated with the (average) manuscript print ratio of the printed image for one page. The conversion table T1 is stored in the conversion table memory portion 113. This table is made on the assumption that, for an A4 size paper, an amount of toner needed for a manuscript print ratio of 1% is 3.5 mg and that a toner supply rate for a unit rotation time of the toner replenishing motor is 350 mg/sec. The above amount of toner needed for the manuscript print ratio of 1% can be calculated by, for example, conducting consecutive printing tests on an A4 manuscript with an overall-black print ratio of 6% and determining an amount of toner consumed on the tests. The amount of toner supply from the toner container 26*a* to the developing container 20 for the unit rotation time of the toner replenishing motor is also determined from a test result in the same manner as the amount of toner needed for the manuscript print ratio of 1% is determined.

The determining portion 173 determines in given timing whether or not to carry out the image adjusting processing, based on information of an accumulated actual toner replenishment time stored in the accumulated actual time memory portion 111 and information of an accumulated expected toner replenishment time stored in the accumulated expected time memory portion 112. The determining portion 173 compares a difference between the accumulated actual toner replenishment time and the accumulated expected toner replenishment time with a threshold (e.g., five seconds), and determines execution of the image adjusting processing when the result of comparison indicates the difference longer than five seconds.

The determination is made in the above manner because that a difference arises between the accumulated actual toner replenishment time and the accumulated expected toner replenishment time despite a toner density kept constant by toner replenishment based on toner density measurement, and that the cause of such a difference is considered to be the fact that the service environment of the apparatus regarded as an assumption for estimating the accumulated expected toner replenishment time is different from the actual service environment of the apparatus. When a difference between the accumulated actual toner replenishment time and the accumulated expected toner replenishment time is large in the above manner, therefore, the image forming apparatus carries out the image quality adjusting processing in accordance with the actual service environment to adjust an image forming condition.

The determining portion 173 carries out the determination in given timing as described above. For example, the determining portion 173 carries out the determination when the accumulated number of printed sheets counted by the number of printed sheets counter 140 exceeds the given number of sheets at reception of a print job. When execution of the image quality adjusting processing is determined once and the image quality adjusting processing has been executed by the image quality adjusting portion 174, for example, the determination is carried out when the accumulated number of printed sheets at reception of a print job is greater than the accumulated number of printed sheets at execution of the previous image adjusting processing by the above given number of sheets.

When the determining portion 173 determines execution of the image adjusting processing, an accumulated actual toner replenishment time and an accumulated expected toner replenishment time are reset (to "0"). The threshold used for the determination is stored in the memory portion 110.

When the determining portion 173 determines execution of the image quality adjusting processing, the image quality adjusting portion 174 forms a reference toner patch on the photosensitive drum making up the image forming portion 150 and adjusts a condition for image forming by the image forming portion 150, based on a result of detection on the patch by the reflection density sensor 160.

Figure 5:
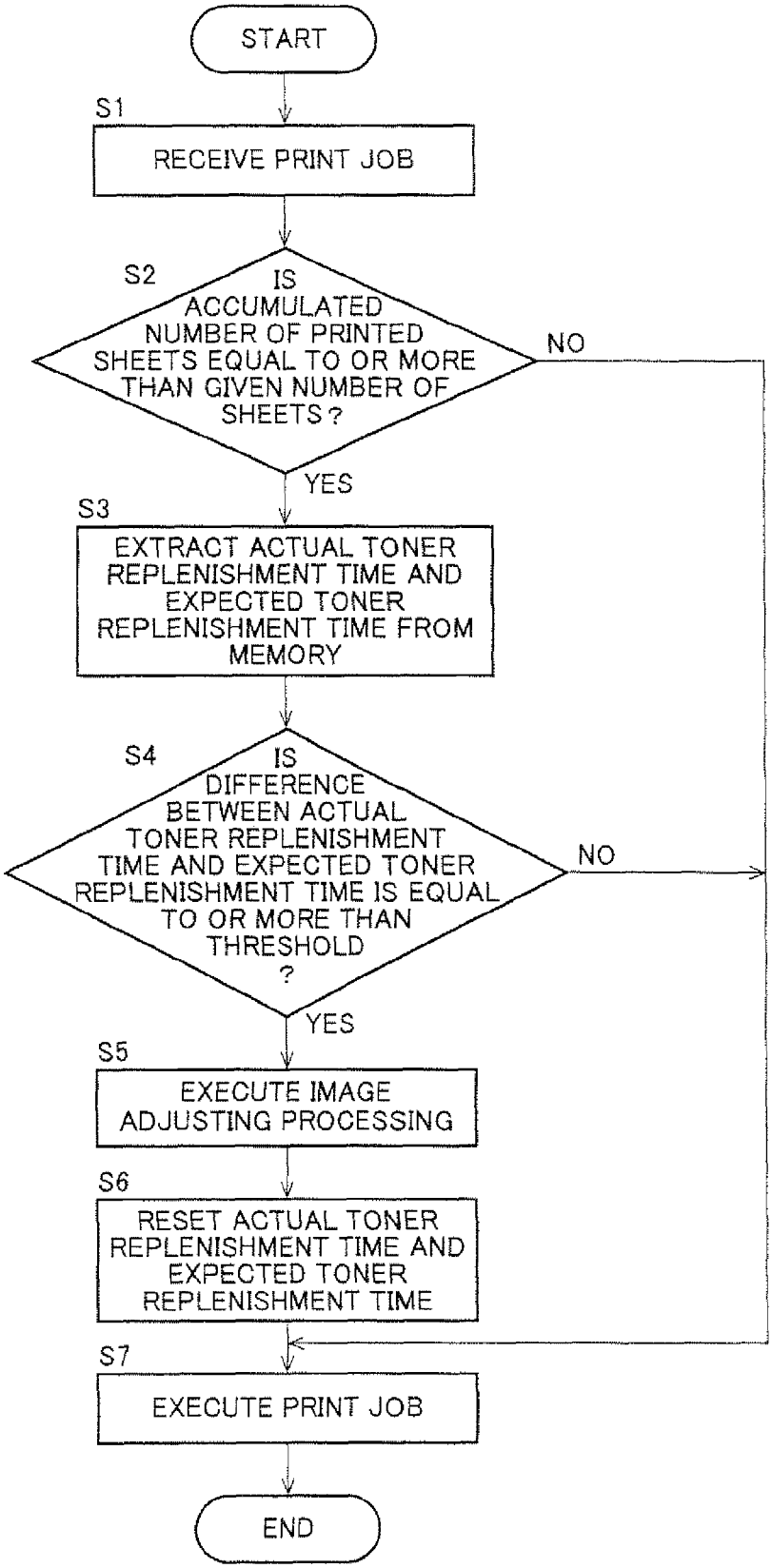
FIG. 5 is a flowchart for explaining an example of a processing of determining timing to execute the image quality adjustment processing in the image forming apparatus of the first embodiment of the present technology.

An example of processing for determining timing to execute the image quality adjusting processing in the image forming apparatus 100 composed of the above constituent portions will then be described with reference to FIG. 5.

In the image forming apparatus 100, when the control portion 170 receives a print job (step S1), the control portion 170 acquires information of the accumulated number of printed sheets before the job reception from the number of printed sheets counter 140 to determine whether the accumulated number of printed sheets has reached the given number of sheets (step S2). When the accumulated number of printed sheets has not reached the given number of sheets yet (NO), the control portion 170 proceeds in process to step S7, at which the print job is started. When the accumulated number of printed sheets has reached the given number of sheets (YES), the control portion 170 proceeds in process to step S3.

At step S3, the control portion 170 extracts information of an accumulated actual toner replenishment time (accumulated actual rotation time of the motor for the toner replenishing roller) and information of an accumulated expected toner replenishment time (accumulated expected rotation time of the motor for the toner replenishing roller) from the accumulated actual time memory unit 111 and the accumulated expected time memory unit 112.

The control portion 170 then calculates a difference between the extracted accumulated actual toner replenishment time and the accumulated expected toner replenishment time, refers to the memory portion 110 having a threshold stored thereon to determine whether the calculated difference is equal to or larger than the threshold (step S4), thus determines whether or not to carry out the image quality adjusting processing.

When the above difference is equal to or larger than the threshold (YES), the control portion 170 proceeds to step S5, at which the image quality adjusting processing is carried out. In the image quality adjusting processing, the image quality adjusting portion 174 controls the image forming portion 150 to form an overall-applying reference toner patch on the photosensitive drum 3. A toner sticking amount on this patch is then measured by the reflection density sensor 160, and conditions for the image forming processing are adjusted based on the result of the measurement. Following the image quality adjusting processing, the control portion 170 proceeds in process to step S6, at which an accumulated actual toner replenishment time and an accumulated expected toner replenishment time stored in the accumulated actual time memory unit 111 and the accumulated expected time memory unit 112 are reset. At step S7 following step S6, the image forming portion 150 is controlled to execute the print job.

When the above difference is smaller than the threshold at step S4 (NO), the image forming apparatus 100 does not carry out the image quality adjusting processing but proceeds in process to step S7, at which the print job is executed.

As described above, the image forming apparatus 100 is capable of varying timing to execute the image quality adjusting processing in accordance with the condition of the apparatus to properly reduce the frequency of execution of the image quality adjusting processing.

It is preferable that the above given number of sheets related to timing of determining whether or not to execute the image quality adjusting processing decrease as the accumulated number of printed sheets increase, as shown in FIG. 6, and that the determination be carried out more frequently as the accumulated number of printed sheets increase. This is because that the accumulated number of printed sheets correspond to a running period of the developer (i.e., period during which the developer is stirred in the developing device to contribute to development) and that a long period of use of the binary developer AG accelerates its deterioration to invite a decline in toner developer stirring capability, thus facilitates the occurrence of trouble at the time of image forming. A trigger number of printed sheets table T2 of FIG. 6 is checked by the control unit 170 for determining timing of carrying out a determination on whether or not to execute the image quality adjusting processing, and is stored in the trigger number of printed sheets table memory portion 114. On the table T2, the accumulated number of printed sheets is represented in unit number of A4 size sheets of 1,000 (K).

Second Embodiment

Figure 7:
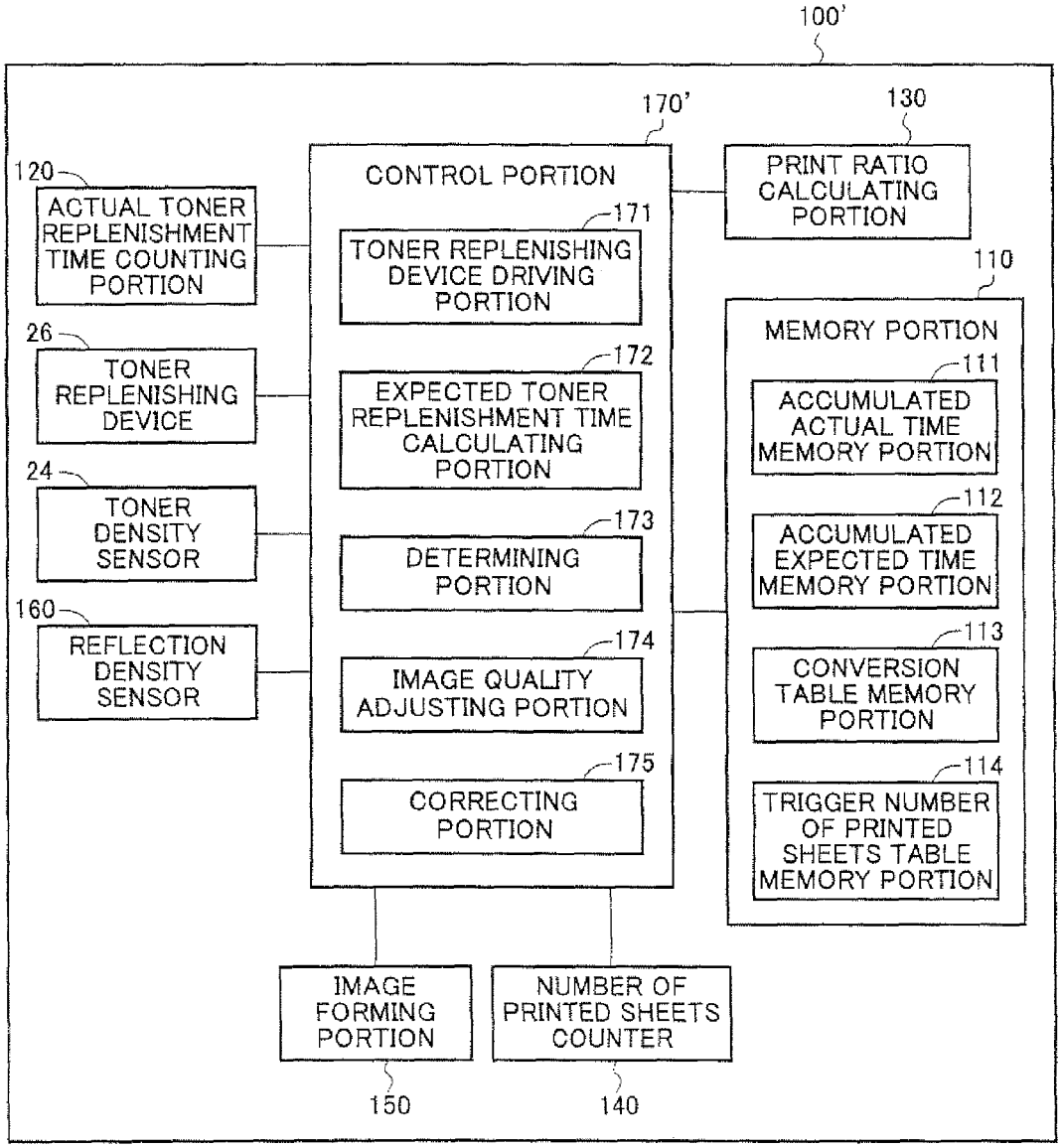
FIG. 7 is a block diagram for explaining a characteristic operation of an image forming apparatus of a second embodiment of the present technology.

FIG. 7 is a block diagram for explaining a characteristic operation of an image forming apparatus of a second embodiment of the present technology. In FIG. 7, the same constituent portions as those of the image forming apparatus of FIG. 1 are denoted by the same reference numerals, and will be omitted in further description. A mechanical construction of the image forming apparatus 100' of FIG. 7 is identical with that of the image forming apparatus 100 of FIGS. 1 and 2.

The image forming apparatus 100' is different from the image forming apparatus 100 of FIG. 3 in that a control portion 170' has a correcting portion 175, which will be described later, and that the conversion table T1 stored in the conversion table memory portion 113 can be rewritten.

Figure 8A:
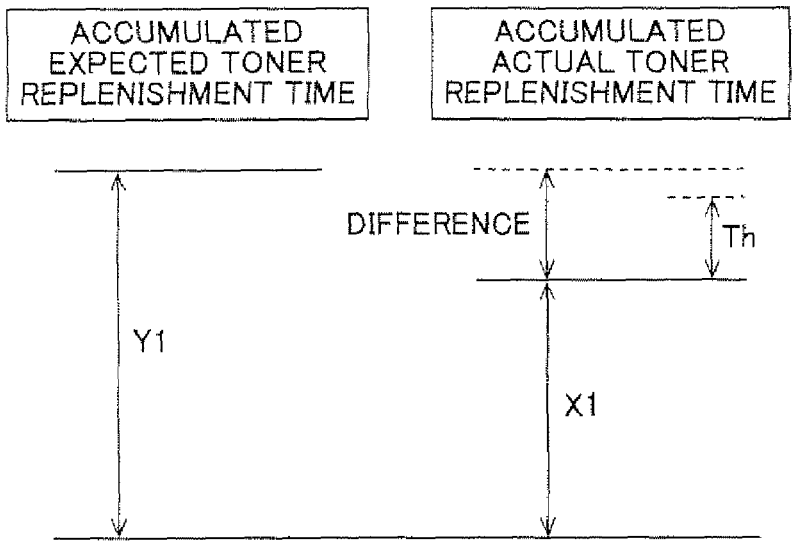
FIGS. 8A and 8B are diagrams for explaining correction carried out by a correcting portion of the image forming apparatus of the second embodiment of the present technology.

A case is assumed where an accumulated expected toner replenishment time Y1 having a difference larger than a threshold Th with an accumulated actual toner replenishment time X1 and being larger than the replenishment time X1, as shown in FIG. 8A, is extracted when the determining portion 173 makes a determination. In this case, the image forming apparatus 100' determines execution of the image quality adjusting processing, thus making an overall-applying reference toner patch on the photosensitive drum 3 as part of the image quality adjusting processing and causing the reflection density sensor 160 to measure the reflection density of the patch to determine whether a target reflection density is acquired. At this time, in a usual case, the target reflection density is not likely to be acquired before adjustment of an image adjusting condition, but nevertheless the target reflection density is acquired in some cases. Because an actual toner replenishment amount is based on a detection result from the toner density sensor, thus determined to be a proper amount, the cause of the difference between accumulated actual toner replenishment time and the accumulated expected toner replenishment time being larger than the threshold is considered to be the fact that a calculation condition for the accumulated expected toner replenishment time is different from an actual calculation condition.

Figure 8B:
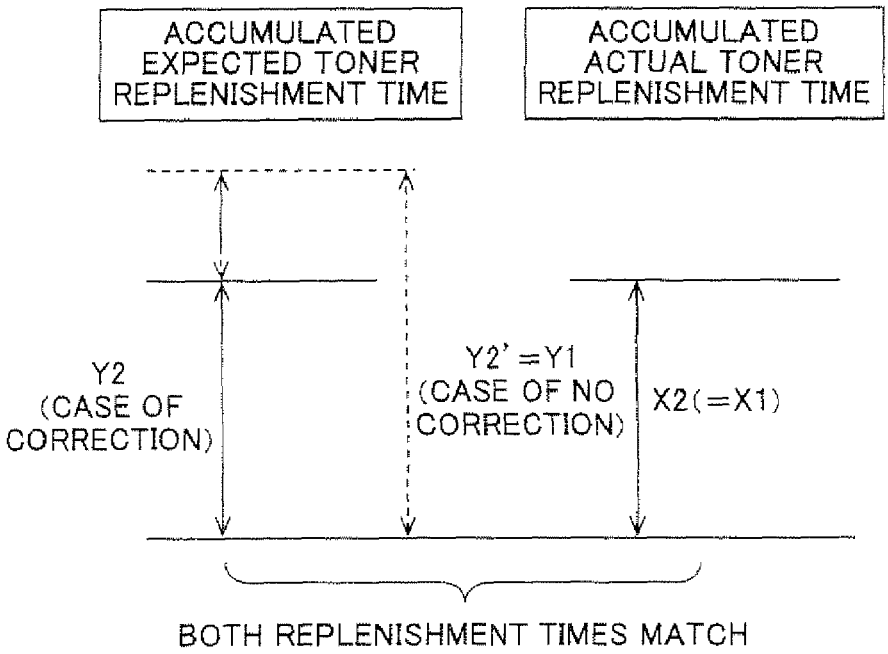

When the reflection density of the reference toner patch is larger than the target reflection density, the correcting portion 175 corrects the accumulated expected toner replenishment time in execution of a determination to follow. FIG. 8B shows an example of such correction, in which, for example, a correction coefficient $\alpha$ is calculated and used as $\alpha$=X1/Y1 based on the accumulated actual toner replenishment time X1 and the accumulated expected toner replenishment time Y1 in the above determination. The conversion table T1 stored in the conversion table memory portion 113 for calculating the accumulated expected toner replenishment time is rewritten based on this correction coefficient $\alpha$. After rewriting of the conversion table T1, the image forming apparatus 100' carries out calculation of a print ratio, etc., based on the rewritten conversion table T1.

As a result, in the image forming apparatus 100', if print records (average print ratio, number of printed sheets, etc.) up to the point of the previous determination remain the same, for example, an accumulated actual toner replenishment time X2 becomes identical with the accumulated actual toner replenishment time X1 and an accumulated expected toner replenishment time Y2 becomes identical with the accumulated actual toner replenishment time X2. In a determination to follow, therefore, no execution of the image quality adjusting processing can be determined in a proper manner.

Figure 9:
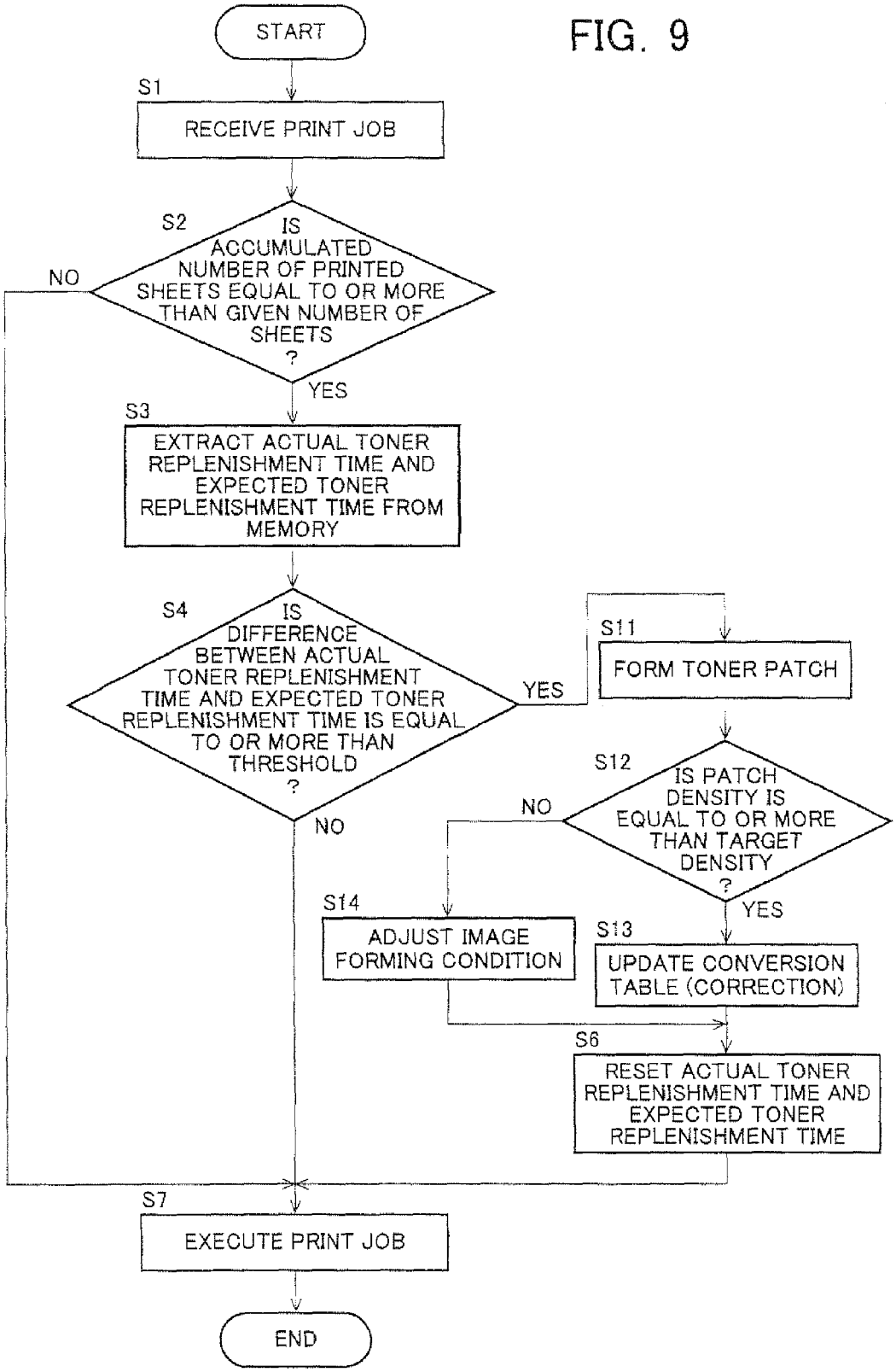
FIG. 9 is a flowchart for explaining an example of a processing for determining timing to execute the image quality adjustment processing in the image forming apparatus of the second embodiment of the present technology.

An example of a process of determining timing to execute the image quality adjusting processing in the image forming apparatus 100' will then be described with reference to FIG. 9. The same portions in the same processing by the image forming apparatus 100 described referring to FIG. 5 are denoted by the same reference numerals and will be omitted in further description.

At step S4, the control portion 170' calculates a difference between an accumulated actual toner replenishment time and an accumulated expected toner replenishment time, which is an accumulation of required times for toner replenishment that are expected based on the conversion table, refers to the memory portion 110 having a threshold stored thereon to determine whether the calculated difference is equal to or larger the threshold, thus determines whether or not to carry out the image quality adjusting processing.

When the above difference is equal to or larger than the threshold (YES), the control portion 170' proceeds to step S11, at which the control portion 170' causes the image quality adjusting portion 174 to start the image quality adjusting processing and controls the image forming portion 150 to form an overall-applying reference toner patch on the photosensitive drum 3. A toner sticking amount on this patch is then measured by the reflection density sensor 160, and whether the reflection density of the reference toner patch is equal to or more than a target density is determined (step S12).

When the reflection density is equal to or more than the target density (YES), the correcting portion 175 calculates a correction coefficient based on the accumulated actual toner replenishment time and the accumulated expected toner replenishment time, and updates the conversion table stored in the conversion table memory portion 113 (step S13), after which the control portion 170' proceeds in process to step S6.

When the reflection density of the reference toner patch is not equal to or more than the target density at step S12 (YES), the image quality adjusting portion 174 adjusts an image forming condition (e.g., adjusts a developing bias) to increase a print density (step S14). Afterward, the process proceeds to step S6.

In the above manner, the image forming apparatus of this embodiment prevents the unnecessary image quality adjusting processing to execute the image quality adjusting processing when necessary even if a predetermined toner consumption amount used for calculating an accumulated expected toner replenishment time is not accurate.

According to the above description, the correcting portion 175 calculates the correction coefficient to correct the conversion table based on the correction coefficient. This is not the only form of correction using the correction coefficient. If the result of correction is reflected on an accumulated expected toner replenishment time in a determination to be made after the above mentioned determination, the correction is applicable. For example, the correction coefficient is stored in advance in the memory portion 110, and a difference between an accumulated actual toner replenishment time and an accumulated expected toner replenishment time that is corrected with the correction coefficient is calculated in a determination to be made after the above mentioned one, and then whether or not to carry out the image quality adjusting processing is determined based on the result of a determination on whether the difference is equal to or more than the threshold.

Timing to execute a determination on whether or not to carry out the image quality adjusting processing is not limited to the timing described in the above two embodiments. For example, once the determination is executed, the determination may be executed again regardless of whether the image quality adjusting processing has actually been carried out or not if sheets have been printed out in the given number at reception of a print job after the previously executed determination. The determination may be executed every time a print job is received. The determination may also be executed regardless of whether a print job is in progress or not when the accumulated number of printed sheets is equal to or more than the given number of sheets.

According to the above description, a determination on whether or not to execute image quality adjustment is carried out based on the number of printed sheets as a trigger. In addition to this case, for example, a drive time of the photosensitive drum, a drive time of the developing roller, an image data volume, etc., may be used as triggers to carry out the determination.

The present technology can apply not only to the image forming apparatus dealing with four-color printing of the above examples, but also to an image forming apparatus dealing with six-color printing and to a monochrome image forming apparatus.

The present technology is not limited to the above embodiments, but various modifications of the technology are possible within the scope of the technology set forth in the appended claims. An embodiment offered as a combination of technical means properly modified within the scope set forth in the claims is, therefore, also included in the technical scope of the present technology.

While the embodiments have been described with a focus set on the image forming apparatus of the present technology, referring to FIGS. 1 to 9, the present technology may be provided in the form of a program. This program is incorporated in a control portion (memory portion, such a ROM, of the control portion) equivalent to an internal computer of the image forming apparatus to cause the control portion (processing unit of the control portion) to execute the procedure of the above embodiments.

According to the present technology, following effect can be obtained.

According to the present technology, a fine printed image without an image quality change can be maintained as a proper toner density is maintained. Timing to execute the image quality adjusting processing is varied in accordance with the situation of the apparatus, so that the frequency of execution of the image quality adjusting processing can be reduced properly. This enables, for example, an improvement in the efficiency of a print job and a reduction in an amount of toner needed for the formation of a reference toner patch in the image quality adjusting processing.

The invention claimed is:

1. An image forming apparatus comprising:

an electrostatic latent image carrier on which an electrostatic latent image is formed based on an image signal;

a developing device that gives toner to the electrostatic latent image to form a toner image;

a detecting portion that detects a toner density in the developing device;

a toner replenishing device that supplies toner to the developing device based on a detection result from the detecting portion so that the toner density takes a given value;

an accumulated actual time memory portion that counts a time for toner replenishment actually carried out by the toner replenishing device, accumulates the count results and stores therein the accumulated count results as an accumulated actual toner replenishment time;

an accumulated expected time memory portion that calculates an expected required time for toner replenishment based on the image signal, accumulates calculation results and stores therein the calculation results as an accumulated expected toner replenishment time;

a determining portion that determines in given timing whether or not to execute an image quality adjusting processing, based on a difference between the accumulated actual toner replenishment time and the accumulated expected toner replenishment time;

a reflection density sensor that detects light reflected from a toner patch formed on the electrostatic latent image carrier; and an image quality adjusting portion that, during an image quality adjustment processing, causes a reference toner patch to be formed on the electrostatic latent image carrier, wherein the reflection density sensor detects light reflected from the reference toner patch, and wherein the image quality adjusting processing is suspended when the reflection light quantity of the reference toner patch is equal to or more than a given value, and the accumulated expected toner replenishment time in the following determination is corrected.

2. The image forming apparatus as defined in claim 1, further comprising a conversion table memory portion that has stored therein a conversion table used for calculating the expected required time for toner replenishment, wherein the accumulated expected toner replenishment time in the following determination is corrected by correcting the conversion table.

3. The image forming apparatus as defined in claim 1, comprising a counter that counts an accumulated number of printed sheets, wherein an interval for executing the determination is reduced as the accumulated number of printed sheets increases.

4. The image forming apparatus as defined in claim 1, wherein a single-cell elastic expandable member is used for a toner replenishing roller of the toner replenishing device.

5. A method for determining timing to execute an image quality adjusting processing in an image forming apparatus including an electrostatic latent image carrier on which an electrostatic latent image is formed, a developing device that gives toner to the electrostatic latent image to form a toner image, a detecting portion that detects a toner density in the developing device, and a toner replenishing device that supplies toner to the developing device, wherein the method comprises the steps of:

supplying toner from the toner replenishing device, based on a detection result from the detecting portion, so that the toner density takes a given value;

counting a time for toner replenishment actually carried out by the toner replenishing device and accumulating count results to calculate the accumulated count results as an accumulated actual toner replenishment time;

calculating an expected required time for toner replenishment based on image signals and accumulating calculation results to calculate the accumulated calculation results as an accumulated expected toner replenishment time;

calculating a difference between the accumulated actual toner replenishment time and the accumulated expected toner replenishment time;

determining in given timing whether or not to execute an image quality adjusting processing, based on the calculated difference; and conducting image quality adjustment processing based on the result of the determination step, wherein during the image quality adjustment processing, a reference toner patch is formed on the electrostatic latent image carrier, a reflection density sensor detects light reflected from the reference toner patch, and wherein the image quality adjusting processing is suspended when the reflection light quantity of the reference toner patch is equal to or more than a given value, and the accumulated expected toner replenishment time in the following determination is corrected.

6. A program operable to cause a computer to execute the method for determining timing to execute an image quality adjusting processing in the image forming apparatus described in claim 5.

* * * * *